United States Patent [19]

Oliver

[11] 4,315,420

[45] Feb. 16, 1982

[54] RETAINED KEY DOUBLE CYLINDER DEADBOLT

[76] Inventor: Ronald N. Oliver, 559 Howard Dr., Salem, Va. 24153

[21] Appl. No.: 139,523

[22] Filed: Apr. 11, 1980

[51] Int. Cl.[3] ..... E05B 9/10; E05B 17/04

[52] U.S. Cl. ..... 70/379 R; 70/389; 70/DIG. 60

[58] Field of Search ..... 70/389, 379 R, 379 A, 70/380, DIG. 60

[56] References Cited

U.S. PATENT DOCUMENTS

| | | | |
|---|---|---|---|
| 4,028,917 | 6/1977 | Schlage | 70/389 |
| 4,068,510 | 1/1978 | Neary | 70/379 R |
| 4,109,496 | 8/1978 | Allemann | 70/380 |

*Primary Examiner*—Robert L. Wolfe

*Attorney, Agent, or Firm*—Bernard, Rothwell & Brown

[57] ABSTRACT

A double cylinder lock bolt has a key for the inside lock cylinder which is retained by a latch operable from the outside locking cylinder. Three alternative means for preventing operation of the inside cylinder by the outside key are disclosed. The arrangement makes a double cylinder deadbolt more suitable for use in fire or panic situation without sacrificing security.

6 Claims, 4 Drawing Figures

FIG. 1
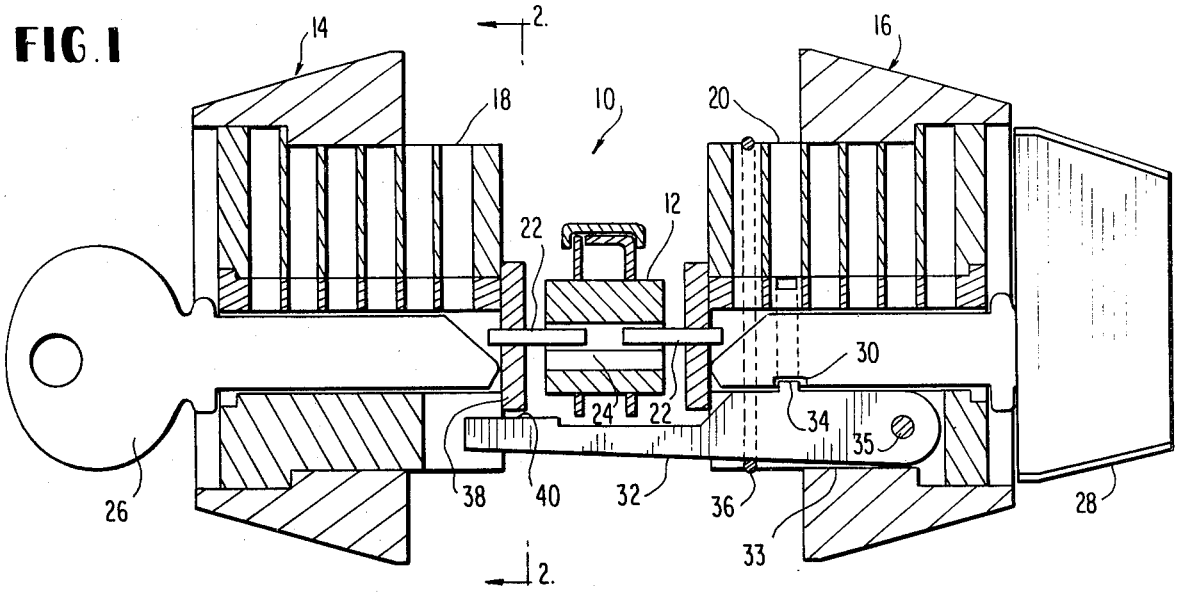
FIG. 2
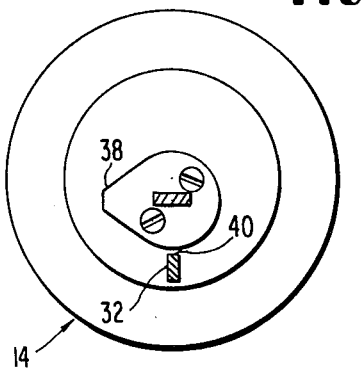
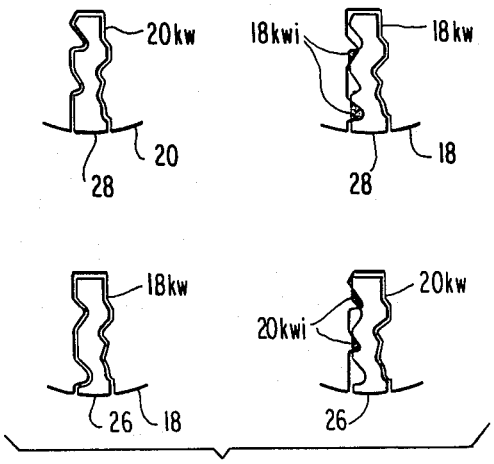
FIG. 3
FIG. 4
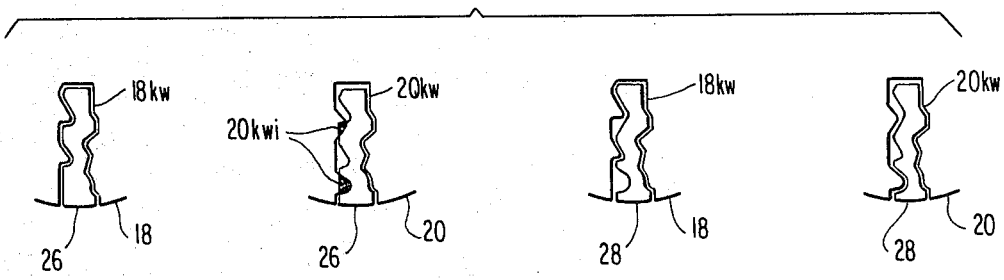

RETAINED KEY DOUBLE CYLINDER DEADBOLT

BACKGROUND OF THE INVENTION

1. Field of the Invention

This invention relates to improvements in double cylinder deadbolts and particularly to a double cylinder deadbolt in which the inside key is retained but can be released only through operation of the outside lock.

2. Description of the Prior Art

Double cylinder lock deadbolts have become important security mechanisms and are recommended by police and security advisors for both residence and commercial applications. A double cylinder lock deadbolt is a deadbolt which may be installed in a door and slidably projected to a stationary keeper with two locking cylinders one on each side of the door. Either of these locking cylinders may be utilized to lock or unlock the deadbolt. The use of two cylinders creates the effect of a double barrier. For maximum security double cylinder deadbolts are recommended even against the burglar who gains entry through a window as then he cannot get out the door because he cannot unlock the door from the inside unless he has the key to the inside cylinder. This eliminates doors as an escape route and also eliminates to some extent the size and weight of the articles which may be stolen and transported as they must be taken back out the path of entry.

Even with the security advantages of double cylinder lock deadbolts, however, there are disadvantages with regard to fire safety which have caused some concern. A number of states have enacted laws which prevent locksmiths from installing double cylinder deadbolts due to fire or panic danger. This danger results if the inside cylinder lock key is removed and not readily available in the case fire or panic preventing exit convenience. Apparently, this fire or panic safety problem was the reason for the state laws prohibiting locksmiths from installing double cylinder deadbolts.

The problem of security on one hand and fire safety on the other hand in connection with double cylinder deadbolts has previously been addressed in my prior patent application, Ser. No. 19,024 filed Mar. 8, 1979 and now abandoned. In that invention, I utilized the concept of a removable key/thumbturn. Even though the invention of that application has been a significant commercial success, it still does not meet some of the objections from a fire safety standpoint in that the inside key might be removed inadvertently thus barring exit in the case of fire or panic. However, if the inside key can be positively retained by a lock and only removed when the outside key is in the lock and is actuated to release the inside key. This would allow the inside key to be removed only when the possessor of the outside key purposely desires to do so, e.g., when leaving a home for vacation or the like. This alleviates the fire and panic danger objection to the usual double cylinder deadbolt because one canot inadvertently or surrepticiously remove the inside key.

Another known double cylinder deadbolt with a safety feature is shown in U.S. Pat. No. 4,068,510, granted Jan. 17, 1978. This patent also provides an arrangement in which the inside key is retained or held but it is retained or held only when the bolt is projected, i.e., when the door is locked. If the door is unlocked, the inside key can be removed. If a double cylinder deadbolt is used in a store or the like where the door is unlocked during working hours, someone can inadvertently remove the inside key when the door is open and then lock the door at the end of the day possibly locking someone in the store without their knowledge. In that case the person in the store has no means of exit.

Accordingly, this invention provides a unique arrangement for retaining the inside key under control of the outside locking cylinder so that the inside key may be retained unless the holder of the outside key purposely unlocks it and remove the inside key.

SUMMARY OF THE INVENTION

This invention provides the double barrier security advantages of a double cylinder lock deadbolt while overcoming the fire-panic safety disadvantages concerning removability of the inside key. This is accomplished by utilizing a mechanical latch cooperating with a notch in the inside key only. The mechanical latch is biased to cooperate with the notch and retain the inside key but may be operated by a cam on the key plug of the outside locking cylinder. However, to prevent anyone from locking themselves in, the arrangement further provides a key arrangement means such that the outside key will not operate the inside lock. Three alternatives may be utilized to accomplish this including different interfering keyways, cross keying the keyways, and master keying the locking cylinders.

BRIEF DESCRIPTION OF THE DRAWINGS

FIG. 1 is a transverse sectional elevation view partially schematic of the retain key double cylinder lock deadbolt of this invention.

FIG. 2 is a sectional view taken along line 2—2 of FIG. 1.

FIG. 3 is a diagrametic illustration of various keys sections and keyways illustrating one means for preventing operation of the inside locking cylinder by the outside key.

FIG. 4 is also a diagrametic illustration of other various key sections and keyways illustrating another means for preventing operation of the inside locking cylinder by the outside key.

DETAILED DESCRIPTION OF THE PREFERRED EMBODIMENT

A double cylinder lock deadbolt assembly is constructed generally in accordance with my prior application, Ser. No. 19,028 filed Mar. 8, 1979 and reference can be had to such prior disclosure for components not fully disclosed herein. Such double cylinder deadbolt is also commercially available from Medeco Security Locks, Inc., Salem, Virginia. The deadbolt assembly includes a deadbolt 12 slidable from a retacted position to a locking position. There is an outside locking cylinder assembly 14 and an inside locking cylinder assembly 16 which in normal use sandwich a door (not shown) between them. Each of the cylinder assemblies includes a locking cylinder. That is, there is an outside locking cylinder 18 and an inside locking cylinder 20. Each of these locking cylinders or cylinder locks are of the type described in U.S. Pat. No. 3,499,302, now U.S. Pat. No. RE 30,198 and for example may be the one and one-half inch diameter solid brass Medeco rim cylinder commercially available from Medeco Security Locks, Inc. of Salem, Va. This Medeco cylinder is commercially available, well-known and includes the twisting tumblers unique to Medeco's locks. Therefore the details of the cylinder locks will not be described.

Each of the cylinder locks, when its plug is turned by a proper bitted key, rotates a tang which functions as a deadbolt actuator 22. The tang fits into a configured hole 24 of the type described in more detail in my prior application referred to above for the purpose of operating the deadbolt. There is an outside key 26 for the outside cylinder and an inside key 28 for the inside cylinder. The inside key may be of the key/tumbturn type described in my prior application. The inside key has a notch 30 in the back of the blade thereof for the purpose of being retained.

For retaining the inside key 28 there is a key retaining latch 32 positioned in a slot 33 and pivoted on the pin 35 for movement toward and away from the inside key. The latch 32 has a tang 34 cooperating with notch 30 in the key as shown in FIG. 1. In the FIG. 1 position the cooperation of the tang 34 and notch 30 prevents withdrawal of the inside key 28. A spring 36 may be positioned around the inside cylinder as shown to bias the latch into key retaining position.

For operating the latch 30 and allowing the inside key 28 to be removed, the plug retainer 38 of the outside cylinder 14 is cam-shaped as shown in FIG. 2. On rotation of the plug the rise of the cam will cause latch 32 to pivot about its pivot pin 35 and allow the tang 34 to clear the notch 30 so that the inside key 28 may be removed.

In addition the cylinder locks 18 and 20 are configured and arranged to provide for means preventing operation of the inside cylinder lock by the outside key for safety purposes. One such means is illustrated in FIG. 2 which shows a portion of the plug of the cylinder lock having a keyway configuration therein and the key section of the key. In the upper left-hand portion of FIG. 3 it can be seen that the inside key 28 fits into the keyway 20*kw* of cylinder 20 and with proper bittings will operate the inside cylinder. In the upper right-hand portion of FIG. 3 it can been seen that the inside key 28 will not pass into the keyway 18*kw* of the outside cylinder 18, there are two areas of interference 18*kwi*. Similarly, with regard to the lower two portions of FIG. 3, there is shown in the left-hand side, the outside key 26 going into the keyway 18*kw* of the outside cylinder 18 and fitting perfectly. However, when the outside key 28 is attempted to be put in the inside keyway 20*kw*, there is interference 20*kwi* so that it will not go. With the arrangement of FIG. 3, the key cross section and keyway configurations are such that the outside key will not operate the inside cylinder and the inside key will not go in the outside cylinder.

FIG. 4 shows another arrangement and in this arrangement the inside key 28 will go into without intereference both the keyway of the inside cylinder 20*kw* (as in the right-hand portion) and the outside cylinder keyway 18*kw* (as in the next to right-hand portion). However, the outside key 26 while fitting in the outside keyway 18*kw* (left-hand portion) will not fit into the inside keyway 20*kw* because of the interference area 20*kwi* (next to the left section of FIG. 4).

There is another means for preventing operation of the inside cylinder by the outside key which is the well-known art of master keying. Master keying involves cutting the bits of the keys to accomplish the desired function on the tumbler and is so well known in the art that it need not be illustrated or described in detail.

It can be seen that there has been disclosed in the preferred embodiment a retained key double cylinder dead lock with important safety provisions such that the inside key of a double cylinder deadlock is retained under the control of the outside key and the outside key cannot operate the inside lock so as to become trapped therein.

I claim:

1. A retained key double cylinder lock deadbolt including:

a. a locking deadbolt assembly with a deadbolt slidable from a retracted position to a locking position;

b. a pair of cylinder lock assemblies, one being an outside cylinder lock and the other being an inside cylinder lock;

c. a locking cylinder in each cylinder assembly;

d. deadbolt actuating means operated by either locking cylinder when the locking cylinder is operated with a proper key for moving the deadbolt from retracted position within the housing to locking position;

e. a pair of proper keys, one for each of the inside locking cyclinder and one for the outside locking cylinder;

with means for retaining the inside key by the improvements comprising:

f. notch means in the inside key only;

g. mechanical latch means adjacent the locking deadbolt assembly and cooperating with the cylinder lock assemblies to be operable by the outside locking cylinder, the mechanical latch means cooperating with the notch means in the inside key to retain the inside key in the inside locking cylinder unless released by operation of the outside locking cylinder under operation of the outside key;

h. and means preventing operation of the inside locking cylinder by the outside key.

2. A retained key double cylinder deadbolt as in claim 1, wherein the means for preventing operation of the inside cylinder by the outside key comprises a keyway of different cross sectional configuration for the inside cylinder and the outside cylinder so that the key for the inside cylinder will not go into the outside cylinder and the key for the outside cylinder will not go into the inside cylinder.

3. A retained key double cylinder deadbolt as claimed in claim 1, wherein the means preventing operation of the inside cylinder by the outside key comprises cross keying of the keyways of the inside and outside locking cylinders so that the key for the outside cylinder will not go into the inside keyway but will go into the outside keyway and the key for the inside cylinder will go into both the inside and outside locking cylinders.

4. A retained key double cylinder deadbolt as claimed in claim 1 wherein the means for preventing operation of the inside cylinder by the outside key comprises master keying the inside and outside locking cylinders so that the key for the inside cylinder will open either the inside or outside locking cylinder but the outside key will not open the inside locking cylinder.

5. A retained key double cylinder deadbolt as in claim 1 wherein the notch means in the inside key only is formed in the back of such key blade.

6. A retained key double cylinder deadbolt as in claim 1 wherein the mechanical latch means comprises a lever pivotally attached to one cylinder lock assembly and having a latch tang which fits into the notch in the inside key, means biasing the lever so that the latch tang cooperates with the notch in the inside key, and a latch operator cam operated by the outside locking cylinder.

* * * * *